US007366429B2

(12) United States Patent
Nakamoto

(10) Patent No.: US 7,366,429 B2
(45) Date of Patent: Apr. 29, 2008

(54) IMAGE FORMING APPARATUS WITH A TONER IMAGE FORMING DEVICE

(75) Inventor: Ikuo Nakamoto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 294 days.

(21) Appl. No.: 11/231,860

(22) Filed: Sep. 22, 2005

(65) Prior Publication Data

US 2006/0067755 A1 Mar. 30, 2006

(30) Foreign Application Priority Data

Sep. 29, 2004 (JP) ..... 2004-285229

(51) Int. Cl.
*G03G 15/00* (2006.01)

(52) U.S. Cl. ..... 399/1; 399/366; 399/401; 399/411

(58) Field of Classification Search ..... 399/1–3, 399/6, 366, 401, 405, 411
See application file for complete search history.

(56) References Cited

U.S. PATENT DOCUMENTS 6,236,831 B1 * 5/2001 Mei et al. ..... 399/411
6,527,384 B2 * 3/2003 Isago ..... 347/100
6,891,640 B2 * 5/2005 Kakikawa et al. ..... 358/1.9
6,934,506 B1 * 8/2005 Collaco ..... 399/405

FOREIGN PATENT DOCUMENTS

| | | |
|---|---|---|
| JP | 7-199738 | 8/1995 |
| JP | 2000-118075 | 4/2000 |
| JP | 2001-228751 | 8/2001 |
| JP | 2002-84386 | 3/2002 |
| JP | 2002-368946 | 12/2002 |
| JP | 2003-271015 | 9/2003 |

* cited by examiner

*Primary Examiner*—William J Royer
(74) *Attorney, Agent, or Firm*—Fitzpatrick, Cella, Harper & Scinto

(57) ABSTRACT

An image forming apparatus having a visible image forming device for forming a visible image on a recording material in a visible image forming area, a supplying device provided with a containing portion for containing the recording material therein, and for supplying the recording material from the containing portion to the visible image forming area, a conveying device for conveying the recording material from the visible image forming area to the containing portion, and an executing device for executing a mode in which the supplying device supplies the recording material having the visible image formed thereon to the visible image forming area, the visible image forming device forms a visible image so as to superimpose it on the visible image formed on the recording material, and the conveying device conveys the recording material having the visible images formed thereon in superimposing relationship with each other to the containing portion.

3 Claims, 5 Drawing Sheets

IMAGE FORMING APPARATUS WITH A TONER IMAGE FORMING DEVICE

BACKGROUND OF THE INVENTION

1. Field of the Invention

The invention relates to an image forming apparatus, and particularly to an image forming apparatus which uses a recording material on one side of which an image has been formed.

2. Related Background Art

In recent years, the senses to environmental problems have been growing on the part of the users of image forming apparatuses. So, from the viewpoint of the saving of natural resources, reusable recording materials having an image formed on one side thereof, but having any image not yet formed on the other side thereof are extensively used. The reusable recording material having an image formed on one side thereof, but having an image not yet formed on the other side thereof will hereinafter be referred to as the backing sheet.

Here, when the image formed on one side includes confidential information, the confidential information may leak out. As a method of preventing the leakage of such confidential information, there is a method of forming a solid image (visible image) on the image-formed side of the backing sheet to thereby paint out a text or image of high confidentiality and make it indecipherable. This method is to set the backing sheet on a sheet supplying cassette (containing portion), and form a solid image on the image-formed side thereof by the user's manual operation. The backing sheet on which the solid image has been formed is discharged onto and stacked on a sheet discharging tray.

According to this method, however, the backing sheet having the solid image formed on the image-formed side thereof and stacked on the sheet discharging tray need be moved from the sheet discharging tray to the sheet supplying cassette by the user for the purpose of forming an image on a side of the backing paper on which any image is not yet formed. Here, there has arisen the problem that the user must do the cumbersome work of moving the backing sheet from the sheet discharging tray to the sheet supplying cassette.

SUMMARY OF THE INVENTION

It is an object of the present invention to make it unnecessary for the user to move a backing sheet stacked on a sheet discharging tray after the formation of a solid image on the image-formed side thereof, for the purpose of forming an image on a side thereof on which any image is not yet formed, and make the use of the backing sheet possible without doing any cumbersome work.

It is another object of the present invention to provide an image forming apparatus having:

visible image forming means for forming a visible image on a recording material in a visible image forming area;

supplying means provided with a containing portion for containing the recording material therein, and for supplying the recording material from the containing portion to the visible image forming area;

conveying means for conveying the recording material from the visible image forming area to the containing portion; and executing means for executing a mode in which the supplying means supplies the recording material having the visible image formed thereon to the visible image forming area, the visible image forming means forms a visible image so as to superimpose the visible image formed on the recording material, and the conveying means conveys the recording material having the visible images formed thereon in superimposing relationship with each other to the containing portion.

DESCRIPTION OF THE PREFERRED EMBODIMENTS

In the present invention, by "providing executing means for executing a mode in which the supplying means supplies the recording material having the visible image formed thereon to the visible image forming area, the visible image forming means forms a visible image so as to superimpose the visible image formed on the recording material, and the conveying means conveys the recording material having the visible images formed thereon in superimposing relationship with each other to the containing portion", it has become unnecessary for the user to move the recording material from a sheet discharging tray to a sheet supplying cassette (containing portion), and it has become possible to mitigate the user's working load.

Some embodiments of the present invention will hereinafter be described.

Embodiment 1

Figure 1:
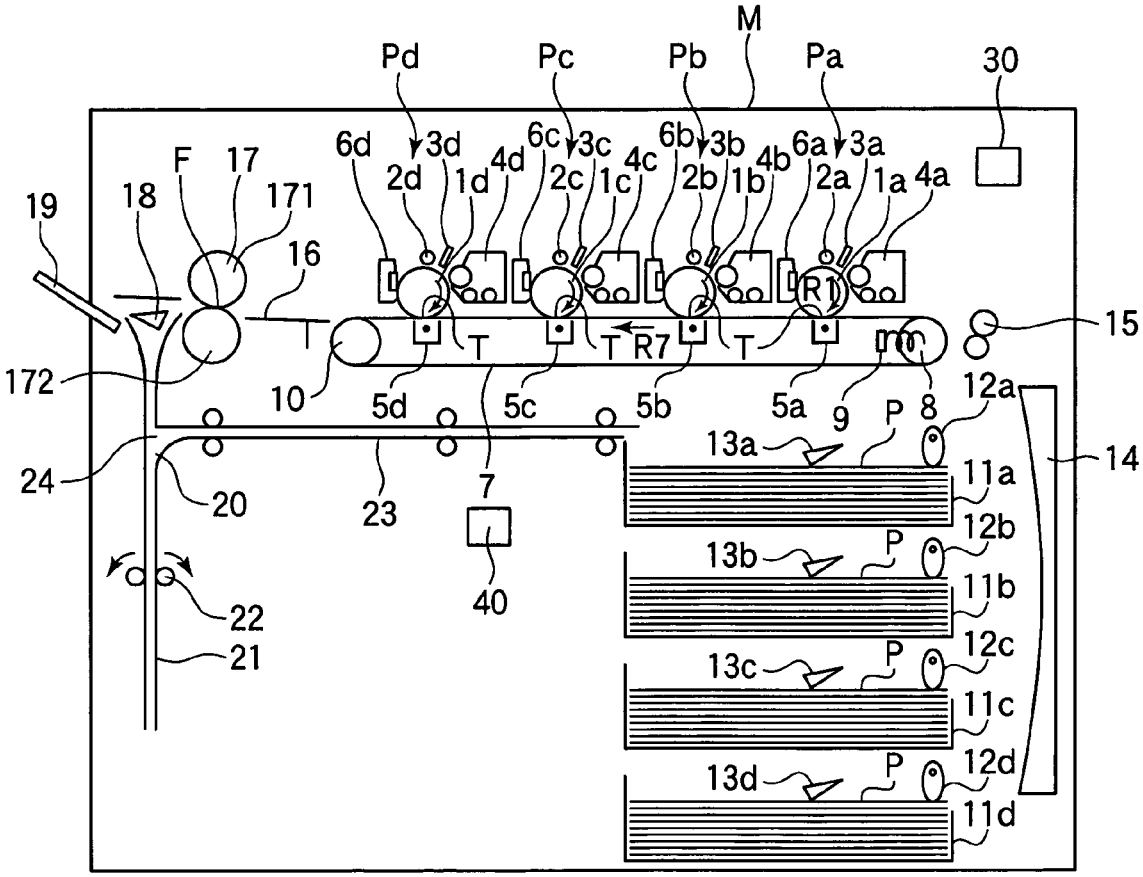
FIG. 1 is a longitudinal cross-sectional view schematically showing the construction of an image forming apparatus to which the present invention can be applied.

FIG. 1 shows an image forming apparatus to which the present invention can be applied. The image forming apparatus shown in FIG. 1 is a four-color full-color electrophotographic type image forming apparatus, and FIG. 1 is a view typically showing a longitudinal cross section in a direction along the conveying direction of a recording material P.

In the image forming apparatus shown in FIG. 1, first, second, third and fourth image forming portions (image forming means) Pa, Pb, Pc and Pd are provided inside an image forming apparatus main body M in succession from an upstream side along the direction of movement of the recording material P.

The image forming portions Pa, Pb, Pc and Pd are similar in construction to one another. The respective image forming portions Pa, Pb, Pc and Pd have drum-shaped electrophotographic photosensitive members (hereinafter referred to as the "photosensitive drum") 1*a*, 1*b*, 1*c* and 1*d*, respectively, as image bearing members rotatable in the direction indicated by the arrow (clockwise direction) in FIG. 1. Around the respective photosensitive drums 1*a*, 1*b*, 1*c* and 1*d*, substantially in the named order along the direction of rotation thereof, there are disposed primary chargers 2*a*, 2*b*, 2*c*, 2*d*, exposing apparatuses 3*a*, 3*b*, 3*c*, 3*d*, developing apparatuses 4*a*, 4*b*, 4*c*, 4*d*, transferring chargers 5*a*, 5*b*, 5*c*, 5*d*, and cleaning apparatuses 6*a*, 6*b*, 6*c*, 6*d*. Of these, the primary chargers 2*a*, 2*b*, 2*c* and 2*d* serve to uniformly charge the surfaces of the photosensitive drums 1*a*, 1*b*, 1*c* and 1*d* to a predetermined polarity and predetermined potential. The exposing apparatuses 3*a*, 3*b*, 3*c* and 3*d* serve to expose the photosensitive drums 1*a*, 1*b*, 1*c* and 1*d* after charged to light to thereby form electrostatic latent images thereon. The developing apparatuses 4*a*, 4*b*, 4*c* and 4*d* serve to cause toners to adhere to the electrostatic latent images formed on the photosensitive drums 1*a*-1*d* to thereby develop the latent images as toner images (visible images). The transferring chargers 5*a*, 5*b*, 5*c* and 5*d* serve to transfer the developed toner images of respective colors onto the recording material P. The cleaning apparatuses 6*a*, 6*b*, 6*c* and 6*d* serve to remove any toners residual on the photosensitive drums 1*a*-1*d* (residual toners).

The above-described developing apparatuses 4*a*, 4*b*, 4*c* and 4*d* contain therein yellow, magenta, cyan and black toners in the named order.

Also, as the above-described transferring chargers 5*a*, 5*b*, 5*c* and 5*d*, use can be made of non-contact chargers like corona chargers, or contact chargers using transfer charging members such as blades, rollers or brushes. The toner images on the photosensitive drums 1*a*, 1*b*, 1*c* and 1*d* are transferred onto the recording material P by the transferring chargers 5*a*, 5*b*, 5*c* and 5*d* in a transferring area T wherein the photosensitive drums 1*a*, 1*b*, 1*c* and 1*d* contact with a recording material carrying member 7.

The non-contact chargers suffer from the problems that ozone is produced and that charging is effected through the air and therefore is liable to be affected by the environmental fluctuations of the temperature and humidity of the atmosphere and images are not stably formed. On the other hand, the contact chargers have the merits that the production of ozone is little, that charging is strong against the environmental fluctuations of temperature and humidity, and that a high quality of image is obtained. Also, in the transferring chargers, it is known that when an electric current contributing to the transfer is made constant by a proper current (constant current control), the image becomes stable, and that when a voltage contributing to the transfer is made constant by a proper voltage (constant voltage control), faulty transfer occurring when a recording material of a small size is used or an image of low image percentage is formed can be reduced.

A recording material conveying belt (recording material carrying member) 7 is disposed below the above-described four image forming portions Pa, Pb, Pc and Pd. The recording material conveying belt 7 is constituted by making a thin belt of a dielectric material into an endless shape. The recording material conveying belt 7 is passed over a driven roller 8 and a drive roller 10. The driven roller 8 is biased rightwardly as viewed in FIG. 1 by a biasing member 9, to thereby impart tension to the recording material conveying belt 7. Also, the driven roller 8 is provided with deviation restricting means (not shown) for preventing the deviation of the recording material conveying belt 7 in the axial direction of the driven roller 8. The recording material conveying belt 7 is rotatively driven in the direction indicated by the arrow R7 by the rotation of the drive roller 10.

Below the recording material conveying belt 7, there is provided supplying means having a plurality of sheet supplying cassettes (containing portions) 11*a*, 11*b*, 11*c*, lid which are a plurality of containing members, sheet feeding rollers 12*a*, 12*b*, 12*c*, 12*d*, a conveying guide 14 and registration rollers 15.

The recording materials P are contained in these sheet supplying cassettes 11*a*, 11*b*, 11*c* and 11*d*, and the recording materials P are fed by the sheet feeding rollers 12*a*, 12*b*, 12*c* and 12*d*, and are conveyed to the registration rollers 15 along the conveying guide 14.

The recording material P is once stopped and has its skew conveyance corrected by the registration rollers 15, and thereafter is supplied to the recording material conveying belt 7 by the registration rollers 15 in such a manner to be synchronized with the toner images on the photosensitive drums 1*a*, 1*b*, 1*c* and 1*d*. The supplied recording material P is borne on the surface of the recording material conveying belt 7.

The recording material P borne on the recording material conveying belt 7 passes through the image forming portions Pa, Pb, Pc and Pd in succession with the rotation of the recording material conveying belt 7. At this time, a transferring bias is applied to the respective transferring chargers 5*a*, 5*b*, 5*c* and 5*d*, whereby the yellow, magenta, cyan and black toner images on the photosensitive drums 1*a*, 1*b*, 1*c* and 1*d* are successively transferred onto the recording material P so as to superimpose one another.

The recording material P is separated from the recording material conveying belt 7 after it has passed through the last fourth image forming portion Pd, and is conveyed to a fixing device 17 along a conveying guide 16. The recording material P is heated and pressurized by the fixing device 17, whereby the toner images of the four colors are fused and secured and fixed on the surface of the recording material P.

The fixing device 17 is provided with a fixing roller 171 for imparting heat to the toner images, and a pressure roller 172 for urging the recording material P against the fixing roller 171. The toner images on the recording material P are heated, pressurized and fixed in a fixing area F wherein the fixing roller 171 and the pressure roller 172 contact with each other.

The recording material P after the toner mages have been fixed is guided by a flapper (changeover member) 18 and is discharged onto a sheet discharging tray 19. The recording material P is separated from the recording material conveying belt 7 and is conveyed to the fixing device 17, in which the toner images of the respective colors transferred in superimposed relationship with one another are fused and fixed, whereafter the recording material P is discharged onto the sheet discharging tray 19.

Here, visible image forming means for forming toner images on the recording material P is formed by the image forming portions Pa, Pb, Pc, Pd, the recording material conveying belt 7 and the fixing device 17. The visible image forming means forms a visible image on the recording material P in a visible image forming area constituted by a transferring area T and a fixing area F.

Figure 5:
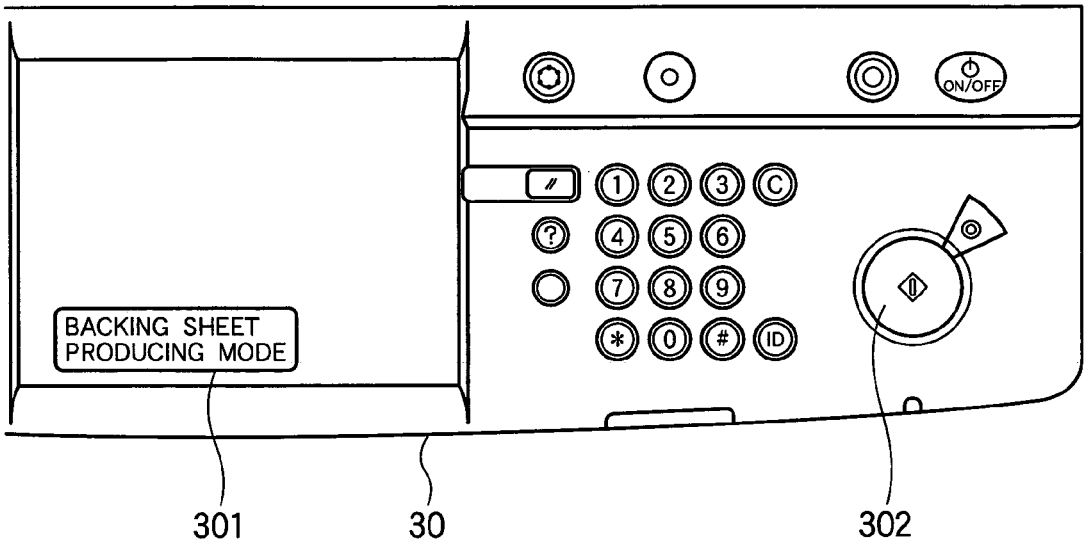
FIG. 5 shows the construction of an operating panel.

Also, on the front side of the upper portion of the image forming apparatus main body M, there is disposed an operating panel 30, shown in FIG. 5, for inputting various image forming conditions, and inputting a starting signal for starting the image forming operation. A backing sheet producing key 301 is provided on this operating panel 30.

Design is made such that this backing sheet producing key 301 is depressed, whereby a backing sheet producing mode (which will be described later) is executed by executing means 40.

The above-described sheet supplying cassettes 11*a*, 11*b*, 11*c* and 11*d* are provided with actuators (full load detecting means) 13*a*, 13*b*, 13*c* and 13*d*, respectively, for detecting the presence or absence and full load of the recording materials P. The actuators 13*a*, 13*b*, 13*c* and 13*d* output amounts of movement corresponding to the numbers of remaining recording materials P in the respective sheet supplying cassettes 11*a*, 11*b*, 11*c* and 11*d*. The amounts of movement of the actuators 13*a*, 13*b*, 13*c* and 13*d* are given to a cassette sheet presence or absence sensor (not shown), which judges the presence or absence of the recording materials P, and outputs a signal indicative of the presence or absence of the recording materials P. The signal from the cassette sheet presence or absence sensor is given to a main control portion (not shown) via an input circuit (not shown).

Figure 2:
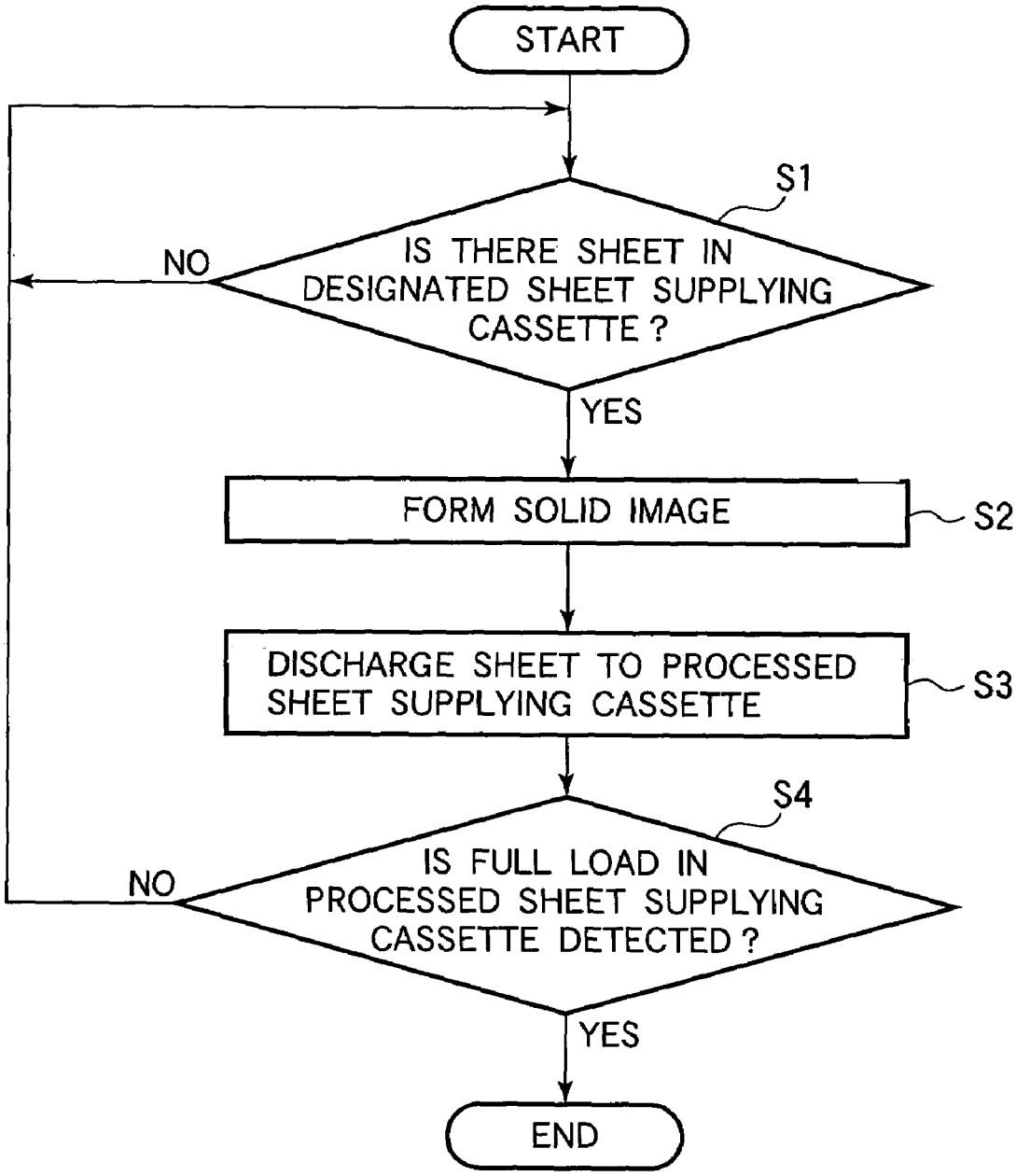
FIG. 2 is a flow chart showing the flow of making a backing sheet in Embodiment 1.

The backing sheet producing operation of effecting solid image formation on the back side of a backing sheet in the present embodiment will now be described with reference to the flow chart of FIG. 2. It is to be understood here that the backing sheet refers to a reusable recording material P having an image formed on one side thereof and having no image formed on the other side thereof. It is also to be understood that as regards the front and back of the backing sheet, the used side on which an image is formed is referred to as the "back side", and the unused side on which no image is formed is referred to as the "front side".

It is to be understood that by the user, the backing sheet is set in one of the sheet supplying cassettes 11*b*, 11*c* and 11*d* with its back side facing downwardly.

The backing sheet producing key 301 is selected on the operating panel 30, and the selection of the sheet supplying cassette 11*b*, 11*c* or 11*d* in which the backing sheet of which the solid image processing is to be executed is set is effected, and a start key 302 (FIG. 5) is depressed. Thus, it follows that the backing sheet (paper) is present in the selected sheet supplying cassette 11*b*, 11*c* or 11*d* (designated sheet supplying cassette) (the step S1 of FIG. 2). The backing sheet in the selected sheet supplying cassette 11*b*, 11*c* or 11*d* is fed by the sheet feeding roller 12*b*, 12*c* or 12*d*. The fed backing sheet is conveyed to the registration rollers 15 along the conveying guide 14, and is supplied to the recording material conveying belt 7. The supplied backing sheet is borne on the surface of the recording material conveying belt 7 with its back side which is the used side facing upwardly. The backing sheet is moved in the same direction as the direction indicated by the arrow R7 by the rotation of the recording material conveying belt 7 in the direction indicated by the arrow R7. On the other hand, in the black image forming portion Pd, by an operation similar to that described above, a solid image is formed on the photosensitive drum 1*d* by a toner (step S2). This solid image is transferred to the back side of the backing sheet which is the used side by the transferring charger 5*d*.

The backing sheet having had the solid image transferred to the back side thereof is separated from the recording material conveying belt 7 and is conveyed to the fixing device 17, where the solid image is fixed. The backing sheet having had the solid image fixed thereon is conveyed from a reversing path 20 to a reversing portion 21 by the flapper 18 being changed over. The backing sheet conveyed to the reversing portion 21, after the trailing edge thereof has passed a branch-off portion 24, is directed to a conveying path 23 with the trailing edge as the head by reversing rollers 22 being reversely rotated in the directions indicated by the arrows.

Thereby, the front and back sides of the backing sheet are reversed. The backing sheet is discharged to (contained in) the sheet supplying cassette 11*a* via the conveying path 23 (step S3). The sheet supplying cassette 11*a* is a processed sheet supplying cassette exclusively for containing a backing sheet subjected to solid image processing. The backing sheet contained in the sheet supplying cassette 11*a* is contained therein with its back side used and having had the solid image fixed thereon facing upwardly. Conveying means for conveying the recording material P after the formation of the solid image thereon to the sheet supplying cassette 11*a* is constituted by the reversing portion 21, the reversing rollers 22, the conveying path 23, and the branch-off portion 24, described above.

This operation is respectively performed until it is detected by a full load detecting sensor that the sheet supplying cassette 11*a* is fully loaded with backing sheets (NO at step S4). When the fully loaded state of the cassette 11*a* is detected by the full load detecting sensor in the sheet supplying cassette 11*a* in which the backing sheets subjected to the solid image processing are contained (YES at step S4), a detection signal indicative of the full load is sent to the main control portion, thus completing the solid image formation.

When the user uses the backing sheet, the user selects the sheet supplying cassette 11*a* exclusively for the sheets subjected to the solid image processing from the operating panel 30, and performs an ordinary image forming operation. Thereby, the image formation by ordinary user input information is effected on the unused side of the backing sheet, and after the fixing treatment, the backing sheet is discharged onto the sheet discharging tray 19.

As described above, the backing sheet, even if a text or image of high confidentiality is formed on the back side thereof, has its confidential side painted out by a solid image being formed on this back side, and therefore it becomes reusable. Further, the processed backing sheet on which the solid image has been formed is automatically contained in the sheet supplying cassette 11*a* which is containing means. That is, the user becomes able to use the backing sheet efficiently.

Embodiment 2

In this embodiment, design is made such that the above-described backing sheet producing operation is performed during the standby of the image forming apparatus. The schematic construction of the image forming apparatus according to this embodiment is similar to that of the image forming apparatus according to the above-described Embodiment 1 described with reference to FIG. 1.

Figure 3:
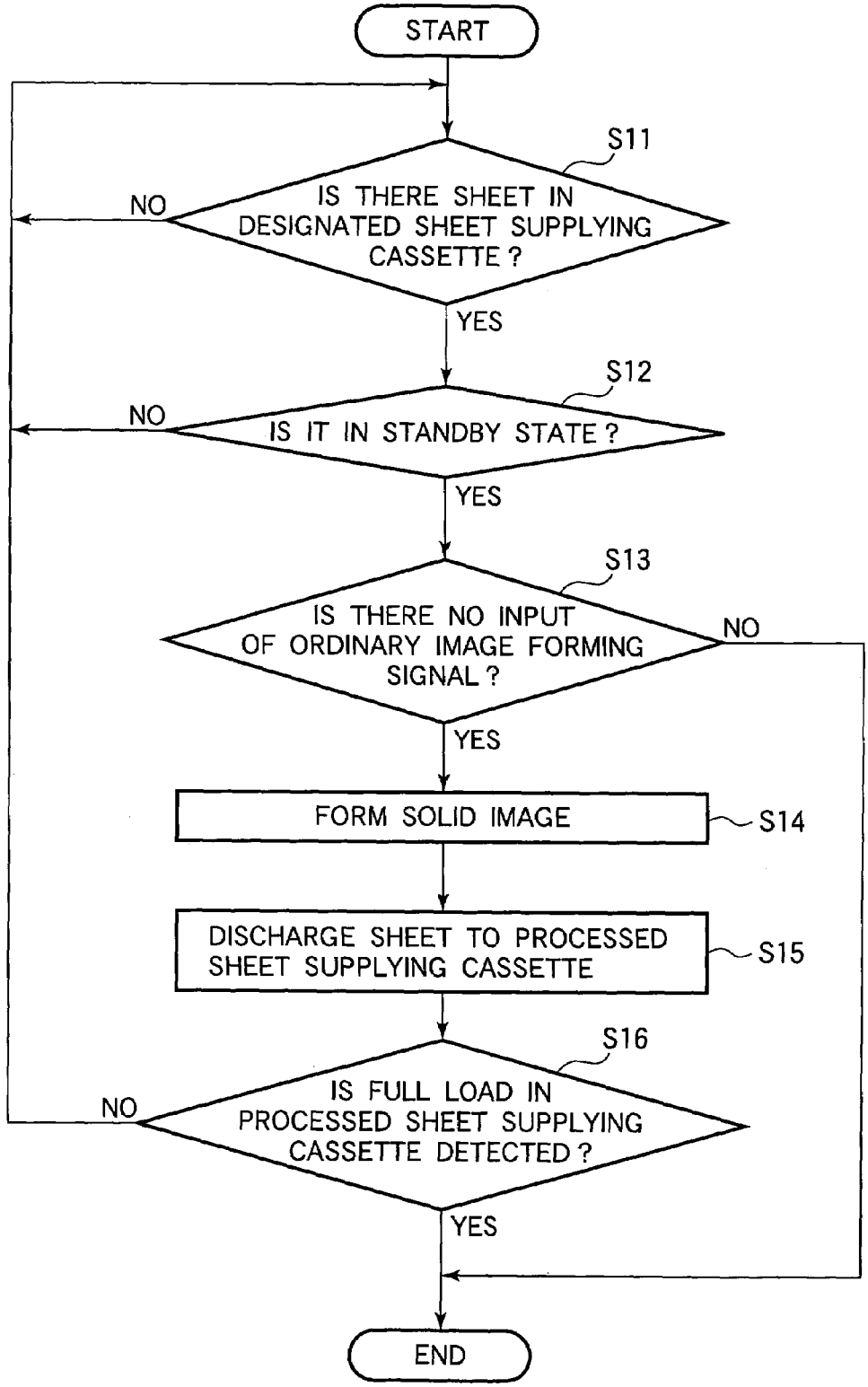
FIG. 3 is a flow chart showing the flow of making the backing sheet in Embodiment 2.

The backing sheet producing operation in the present embodiment will now be described with reference to FIG. 3.

First, it is to be understood that by the user, the backing sheet is set in one of the sheet supplying cassettes 11*b*, 11*c* and 11*d* with its back side facing downwardly. When the backing sheet producing key 301 is selected on the operating panel 30 and setting is effected to the selection of the sheet supplying cassette 11*b*, 11*c* or 11*d* in which the backing sheet on which the solid image processing is to be executed and to an automatic producing mode, the cassette presence or absence detecting sensor produces a detection signal indicative of the fact that the backing sheet is present in the designated cassette 11*b*, 11*c* or 11*d*, on the basis of the amount of movement of the actuator (YES at step S11 of FIG. 3), and the detection signal is given to the main control portion through an input circuit.

The main control portion confirms whether image forming apparatus is on standby in which it is not executing the image forming operation, and judges whether solid image formation is possible (step S12). If the image forming apparatus is on standby (YES at step S12), solid image formation is started (step S14), but if at this time, an ordinary image forming signal by input information from the user has already been inputted, an ordinary image forming operation is preferentially performed. The solid image formation is not started until the ordinary image forming operation is terminated and shift is made to the standby state.

Also, if during the backing sheet production, an image forming operation signal by ordinary input information from the user has entered, the solid image forming operation is terminated (NO at step S13), and ordinary image formation is preferentially executed.

If backing sheet production is judged to be possible, as in the aforedescribed Embodiment 1, the backing sheet in the selected sheet supplying cassette 11*b*, 11*c* or 11*d* is fed to the image forming apparatus main body M, and is placed on the recording material conveying belt 7 with its used side facing upwardly. By the movement of the recording material conveying belt 7, the backing sheet is conveyed in the direction indicated by the arrow R7, and in the image forming portion Pd, a solid image is formed on the used side of the recording material P.

The backing sheet having had the solid image transferred thereto is separated from the recording material conveying belt 7 (see FIG. 1) and is conveyed to the fixing device 17, where the solid image is fixed thereon. The backing sheet on which the solid image has been fixed is conveyed from the reversing path 20 to the reversing portion 21 by the flapper 18 being changed over. The backing sheet conveyed to the reversing portion 21, after the trailing edge thereof has passed the branch-off portion 24, is directed to the conveying path 23 with the trailing edge thereof as the head, by the reversing rollers 22 being reversely rotated in the directions indicated by the arrows. Thereby, the front and back sides of the backing sheet are reversed. The backing sheet is discharged to (contained in) the sheet supplying cassette 11*a* via the conveying path 23 (step S15). The sheet supplying cassette 11*a* is a processed sheet supplying cassette for containing therein exclusively backing sheets subjected to solid image processing. The backing sheet contained in the sheet supplying cassette 11*a* is contained therein with its back side used and having had the solid image fixed thereon facing upwardly.

This operation is repetitively performed until it is detected by the full load detecting sensor that the sheet supplying cassette 11*a* is fully loaded with backing sheets (NO at step S16). When the fully loaded state of the cassette 11*a* is detected by the full load detecting sensor in the sheet supplying cassette 11*a* in which the backing sheets subjected to the solid image processing are contained (YES at step S16), a detection signal indicative of the full load is sent to the main control portion, thus completing the solid image formation.

As described above, a solid image is formed on the backing sheet on which a text or image of high confidentiality is formed to thereby paint out the confidential side, and therefore, such backing sheet becomes reusable and also, the backing sheet producing work is automatically executed during the standby and therefore, the user's working load is mitigated and it becomes possible to use the backing sheet efficiently while the productivity in ordinary image formation remains maintained.

Figure 4:
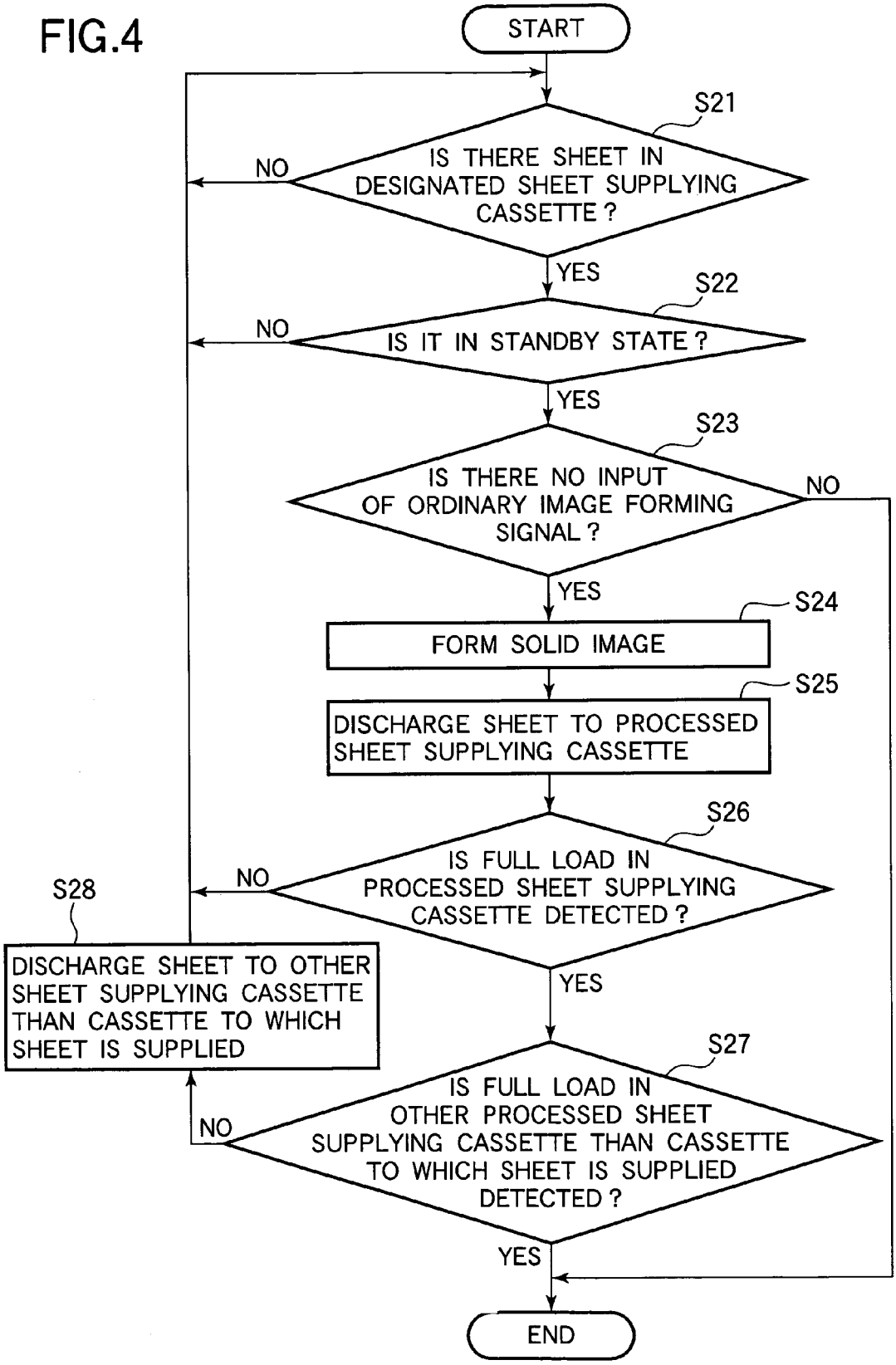
FIG. 4 is a flow chart showing the flow of making the backing sheet in Embodiment 3.

The flow of steps S21-S26 in FIG. 4 described above is similar to that of steps S11-S16 in FIG. 3 described previously.

Embodiment 3

In this embodiment, when the sheet supplying cassette 11*a* for containing therein backing sheets subjected to solid image processing has become fully loaded, these backing sheets are conveyed to another sheet supplying cassette which is not in its fully loaded state.

The schematic construction of the image forming apparatus according to the present embodiment is substantially similar to that of the image forming apparatus described in the Embodiment 1 of FIG. 1. In the image forming apparatus according to the present embodiment, however, a conveying path similar to the conveying path 23 in FIG. 1 is disposed at a location corresponding to the sheet supplying cassettes 11*b*, 11*c* and 11*d*. That is, design is made such that a reversed backing sheet can be discharged to any one of the sheet supplying cassettes 11*a*, 11*b*, 11*c* and 11*d*.

The backing sheet producing operation in the present embodiment will now be described with reference to FIG. 4.

First, it is to be understood that backing sheets are set in one of the sheet supplying cassettes 11*b*, 11*c* and 11*d* by the user with the back side thereof facing downwardly. When the backing sheet producing key is selected on the operating panel 30, and setting is done to the selection of the sheet supplying cassette 11*b*, 11*c* or 11*d* in which the backing sheets of which the solid image processing is to be executed are set, and an automatic producing mode, the cassette sheet presence or absence detecting sensor produces a detection signal indicative of the presence of the backing sheets in the designated cassette 11*b*, 11*c* or 11*d* on the basis of the amount of movement of the actuator (YES at step S21 in FIG. 4), and the detection signal is given to the main control portion through the input circuit.

The main control portion confirms whether the image forming apparatus is in its standby state in which it is not executing the image forming operation, and judges whether solid image formation is possible (step S22). If the image forming apparatus is in its standby state (YES at step S22), the solid image formation is started (step S24), but if at this time, an ordinary image forming signal by input information from the user is already inputted, an ordinary image forming operation is preferentially performed. The solid image formation is not started until the ordinary image forming operation is terminated and shift is made to the standby state.

Also, when during backing sheet production, the ordinary image forming operation signal by the input information from the user has come in, the solid image forming operation is terminated (NO at step S23), and the ordinary image formation is preferentially executed.

When it is judged that backing sheet production is possible, as in the aforedescribed Embodiment 1, the backing sheet in the selected sheet supplying cassette 11*b*, 11*c* or 11*d* is fed to the image forming apparatus main body M, and is placed on the recording material conveying belt 7 with its used side facing upwardly. By the movement of the recording material conveying belt 7, the backing sheet is conveyed in the direction indicated by the arrow R7, and in the image forming portion Pd, a solid image is formed on the used side thereof.

The backing sheet having had the solid image formed on its back side is separated from the recording material conveying belt 7 (see FIG. 1), and is conveyed to the fixing device 17, where the solid image is fixed. The backing sheet on which the solid image has been fixed is conveyed from the reversing path 20 to the reversing portion 21 by the flapper 18 being changed over. The backing sheet conveyed to the reversing portion 21, after the trailing edge thereof has passed the branch-off portion 24, is directed to the conveying path 23 with its trailing edge as the head, by the reversing rollers 22 being reversely rotated in the directions indicated by the arrows. Thereby, the backing sheet is reversed. The backing sheet is discharged to (contained in)

the sheet supplying cassette 11*a* via the conveying path 23 (step S24). The sheet supplying cassette 11*a* is a processed sheet supplying cassette for containing therein exclusively backing sheets subjected to the solid image processing. The backing sheet contained in the sheet supplying cassette 11*a* is contained therein with its back side used and having had the solid image fixed thereon facing upwardly.

This operation is respectively performed until it is detected by the full load detecting sensor that the sheet supplying cassette 11*a* is fully loaded with backing sheets (NO at step S26). When the fully loaded state of the cassette 11*a* is detected by the full load detecting sensor in the sheet supplying cassette 11*a* for containing therein backing sheets subjected to solid image processing (YES at step S26), a detection signal indicative of the fully loaded state is sent to the main control portion.

The flow of the steps S21-S26 in FIG. 4 described above is similar to that of steps S11-S16 in FIG. 3 described previously.

The main control portion to which the detection signal indicative of the fully loaded state judges the fully loaded state of other sheet supplying cassette than the sheet supplying cassettes which have supplied unprocessed backing sheets, by a signal sent from the sensor, and if there is a sheet supplying cassettes not fully loaded (step S27), the conveying direction is changed by a flapper (not shown) in the conveying path, and backing sheets subjected to solid image processing are contained in another sheet supplying cassette (step S28). When the another sheet supplying cassette also becomes fully loaded (step S27), solid image formation is terminated.

By the construction as described above, it is possible to contain reusable backing sheets subjected to solid image processing in the cassette in a great deal and therefore, it becomes possible to use the backing sheets efficiently.

This application claims priority from Japanese Patent Application No. 2004-285229 filed on Sep. 29, 2004, which is hereby incorporated by reference herein.

What is claimed is:

1. An image forming apparatus comprising:

a toner image forming device, which forms an ordinary toner image and a toner pattern on a recording material moving through a toner image forming area;

a first containing portion, which contains a recording material having an image formed on one side of the recording material;

a first conveying path, which conveys the recording material in the first containing portion to the toner image forming area;

a second containing portion, which contains the recording material passed through the toner image forming area;

a second conveying path, which conveys the recording material from the toner image forming area to the second containing portion;

a third conveying path, which conveys the recording material in the second containing portion to the toner image forming area, wherein a direction in which the recording material conveyed by the third conveying path is moved through the toner image forming area is the same as a direction in which the recording material conveyed by the first conveying path is moved through the toner image forming area; and executing means for executing a toner pattern forming mode in which the recording material in the first containing portion is conveyed to the toner image forming area to form the toner pattern superimposed on the image on the recording material, and thereafter the recording material is conveyed to the second containing portion, and an ordinary toner image forming mode in which the recording material having the toner pattern formed thereon is conveyed from the second containing portion to the toner image forming area to form the ordinary toner image on a side of the recording material opposite to a side on which the toner pattern is formed.

2. The image forming apparatus according to claim 1, wherein the toner pattern forming mode is executed in a period other than a period for executing the ordinary toner image forming mode.

3. The image forming apparatus according to claim 2, wherein when an execution of the ordinary toner image forming mode is induced in an execution of the toner pattern forming mode, the toner pattern forming mode is terminated so that the ordinary toner image forming mode is executed.

* * * * *